US007865988B2

(12) United States Patent
Koughan et al.

(10) Patent No.: US 7,865,988 B2
(45) Date of Patent: Jan. 11, 2011

(54) SLEEPING SURFACE HAVING TWO LONGITUDINALLY CONNECTED BLADDERS WITH A SUPPORT MEMBER

(75) Inventors: Daniel J. Koughan, Eden Prairie, MN (US); Tracey Thompson, Shoreview, MN (US); Darryl L. Schmitz, Plymouth, MN (US); Jennifer Bertram, Maple Grove, MN (US)

(73) Assignee: Select Comfort Corporation, Minneapolis, MN (US)

( * ) Notice: Subject to any disclaimer, the term of this patent is extended or adjusted under 35 U.S.C. 154(b) by 611 days.

(21) Appl. No.: 11/753,387

(22) Filed: May 24, 2007

(65) Prior Publication Data

US 2007/0277325 A1 Dec. 6, 2007

Related U.S. Application Data

(63) Continuation-in-part of application No. 10/801,769, filed on Mar. 16, 2004, now abandoned.

(51) Int. Cl.
*A47C 27/10* (2006.01)

(52) U.S. Cl. ..... 5/691; 5/710; 5/711

(58) Field of Classification Search ..... 5/640, 5/657, 691, 710, 722
See application file for complete search history.

(56) References Cited

U.S. PATENT DOCUMENTS

| | | | | | |
|---|---|---|---|---|---|
| 195,850 | A | * | 10/1877 | Shepherd | 5/723 |
| 1,475,771 | A | * | 11/1923 | Aldridge | 5/710 |
| 1,885,974 | A | | 11/1932 | Winn | |
| 2,247,667 | A | * | 7/1941 | Roseberger | 5/723 |
| 2,367,835 | A | | 1/1945 | Kreyer | |
| 2,415,150 | A | | 2/1947 | Stein | |
| 2,549,597 | A | | 4/1951 | Harris et al. | |
| 2,614,272 | A | | 10/1952 | Morner | |
| 2,651,788 | A | | 9/1953 | Forwood | |
| 2,879,523 | A | | 3/1959 | Klassen et al. | |
| 3,128,480 | A | | 4/1964 | Lineback | |
| 3,274,624 | A | | 9/1966 | Noerdinger | |
| 3,308,492 | A | * | 3/1967 | Lovette | 5/722 |
| 3,319,273 | A | | 5/1967 | Solin | |
| 3,428,974 | A | | 2/1969 | Stuart | |
| 3,731,327 | A | | 5/1973 | Frey | |
| 4,128,907 | A | | 12/1978 | Gelbart | |
| 4,167,432 | A | * | 9/1979 | Mollura | 156/274.4 |
| 4,251,308 | A | * | 2/1981 | Miller | 156/211 |
| 4,991,244 | A | * | 2/1991 | Walker | 5/400 |
| 5,245,719 | A | * | 9/1993 | Ott | 5/632 |
| 5,642,546 | A | * | 7/1997 | Shoenhair | 5/680 |
| 5,771,514 | A | * | 6/1998 | Wilhoit | 5/644 |
| 5,794,289 | A | * | 8/1998 | Wortman et al. | 5/713 |
| 5,987,668 | A | | 11/1999 | Ackley | |
| 6,161,231 | A | * | 12/2000 | Kraft et al. | 5/18.1 |
| 6,739,001 | B2 | * | 5/2004 | Flick et al. | 5/425 |
| 2003/0041378 | A1 | * | 3/2003 | Davis | 5/615 |

* cited by examiner

*Primary Examiner*—Tara Mayo-Pinnock
(74) *Attorney, Agent, or Firm*—Barbara A. Wrigley; Oppenheimer Wolff & Donnelly LLP

(57) ABSTRACT

A sleep surface is formed by joining longitudinal sides of two juxtaposed air bladders, thereby providing a continuous sleep surface having two independently inflatable air chambers. A support member can be inserted between the two independently inflatable air bladders to provide a continuous sleep surface that eliminates vertical displacement of a user.

29 Claims, 8 Drawing Sheets

SLEEPING SURFACE HAVING TWO LONGITUDINALLY CONNECTED BLADDERS WITH A SUPPORT MEMBER

CROSS REFERENCE TO RELATED APPLICATIONS

This application is a continuation-in-part of U.S. application Ser. No. 10/801,769 filed Mar. 16, 2004, the entirety of which is hereby incorporated by reference.

BACKGROUND OF THE INVENTION

Airbeds are rapidly gaining popularity as an alternative to inner spring mattresses. One of the most attractive features of an airbed is the inherent firmness adjustability. As opposed to a non-adjustable inner spring mattress, the firmness of an air bed can be quickly adjusted simply by changing the air pressure in the bladders of the bed. The larger beds include two juxtaposed bladders, thereby providing two independently adjustable sleep surfaces in a single bed.

As depicted in FIG. 1, beds offering two bladders were originally constructed simply by providing a cover 2, inserting a foam border 4 around the inner sidewalls of the cover 2 to provide a desirable shape for the mattress 10, and inserting two independent juxtaposed bladders 12, 14 inside the foam border 4. Based on this construction, some customers expressed concern that when they were on inside edge 8 of their bladder 12 or 14, toward the center of the bed, their body weight forced all of the air in the bladder 12 or 14 toward the outer side 6 of the bladder 12 or 14, leaving them in a low point on the mattress. If their sleeping partner was lying on the center of the other bladder 12 or 14, the inside edge 8 of the spouse's bladder 12 or 14 would be fully inflated. The discontinuity between the inside edge 8 of the compressed bladder 12 or 14 and the fully inflated adjoining inside edge 8 of the adjacent bladder 12 or 14, created an uncomfortable sleeping surface. Though this problem was somewhat alleviated by the incorporation of foam covers and pillow top mattress covers, the effect was still noticeable.

Recently, another advantage of airbeds has resulted in the development of sleeper sofas with airbed mattresses. The advantage is that the airbeds can be deflated, virtually eliminating the space used by the mattress. Conventional sleeper sofa designs are plagued with a struggle between providing a comfortable sleep surface when the bed is deployed, and providing an attractive sofa when the bed is hidden away. A thick, comfortable mattress is difficult to fold into a couch. Mattresses that are foldable are too thin to insulate a sleeper from the non-uniform support surface under the mattress.

Airbed mattresses eliminate this problem because they can be deflated before the bed is folded into the couch. Thus, the thickness of the mattress is completely independent of the mechanical structure of the sofa mechanisms. The development of airbed sleeper sofas has quickly progressed to the inclusion of a mattress having two bladders.

A sleeper sofa airbed mattress with two bladders brings with it the same potential problem of a gap between the bladders when inflated. The deflation of the bladders during storage creates a new potential problem as well. Namely, the deflated bladders may become overlapped or otherwise wrongly positioned during the folding and unfolding of the sleeper sofa. Simply placing a piece of foam between the bladders is not effective because when left unsecured, unattached or otherwise not held in place between the bladders, the foam is likely to become displaced when the bladders are inflated, deflated, folded and/or unfolded.

Thus, there is a need for an airbed mattress having two independent bladders that remain in position while being inflated, deflated, folded and/or unfolded. There is a further need for this mattress to provide a sufficient level of firmness across the extents of the mattress so an individual sleeper does not feel drawn to a depression in the middle of the bed. There is yet another need for securing a support member between two independent air bladders such that the support member remains in position while the two independent bladders are inflated, deflated, folded and/or unfolded.

BRIEF SUMMARY OF THE INVENTION

The present invention relates to an airbed mattress that provides a solution to the aforementioned problems. More specifically, the present invention relates to an airbed mattress that includes two juxtaposed bladders that are joined along adjoining longitudinal edges. The union formed not only keeps the bladders in place during deflation and folding, but a bridge is formed between the mattresses creating a relatively constant sleep surface across the extents of the mattress. An additional support member prevents an individual sleeper from rolling to the center of the mattress.

Thus, one aspect of the present invention provides a sleep surface for two people comprising a first bladder having a longitudinal side and a second bladder having a longitudinal side attached to the longitudinal side of the first bladder. Each bladder is constructed and arranged to maintain an air pressure therein that is independent of an air pressure in the other bladder. The feature of two independently adjustable sleep surfaces is thus maintained. Additionally, a support member can be inserted between the bladders to enhance the continuous sleep surface of the air mattress.

The longitudinal sides of the two bladders may be heat welded, zipped, connected with hook and loop fasteners, snap fasteners, tied, or any acceptable fastening means. Additionally, the sides of the two bladders may be connected at an upper edge or both an upper and lower edge.

Another aspect of the present invention provides a method of creating an uninterrupted sleep surface with two bladders. The method includes providing a first elongate bladder and a second elongate bladder. The bladders are then juxtaposed, a support member is inserted between them, and they are joined together. Joining the bladders is accomplished through heat welding, zipping, connecting with hook and loop fasteners, connecting with snap fasteners, tying the bladders together, or any acceptable fastening means.

Yet another aspect of the present invention provides a mattress with a sufficiently thin profile, when deflated, to be capable of being folded into a sleeper sofa; and when inflated provides sufficient insulation between the sleeper and the non-uniform support surface under the mattress to ensure a restful night's sleep.

DETAILED DESCRIPTION OF THE INVENTION

Figure 1:
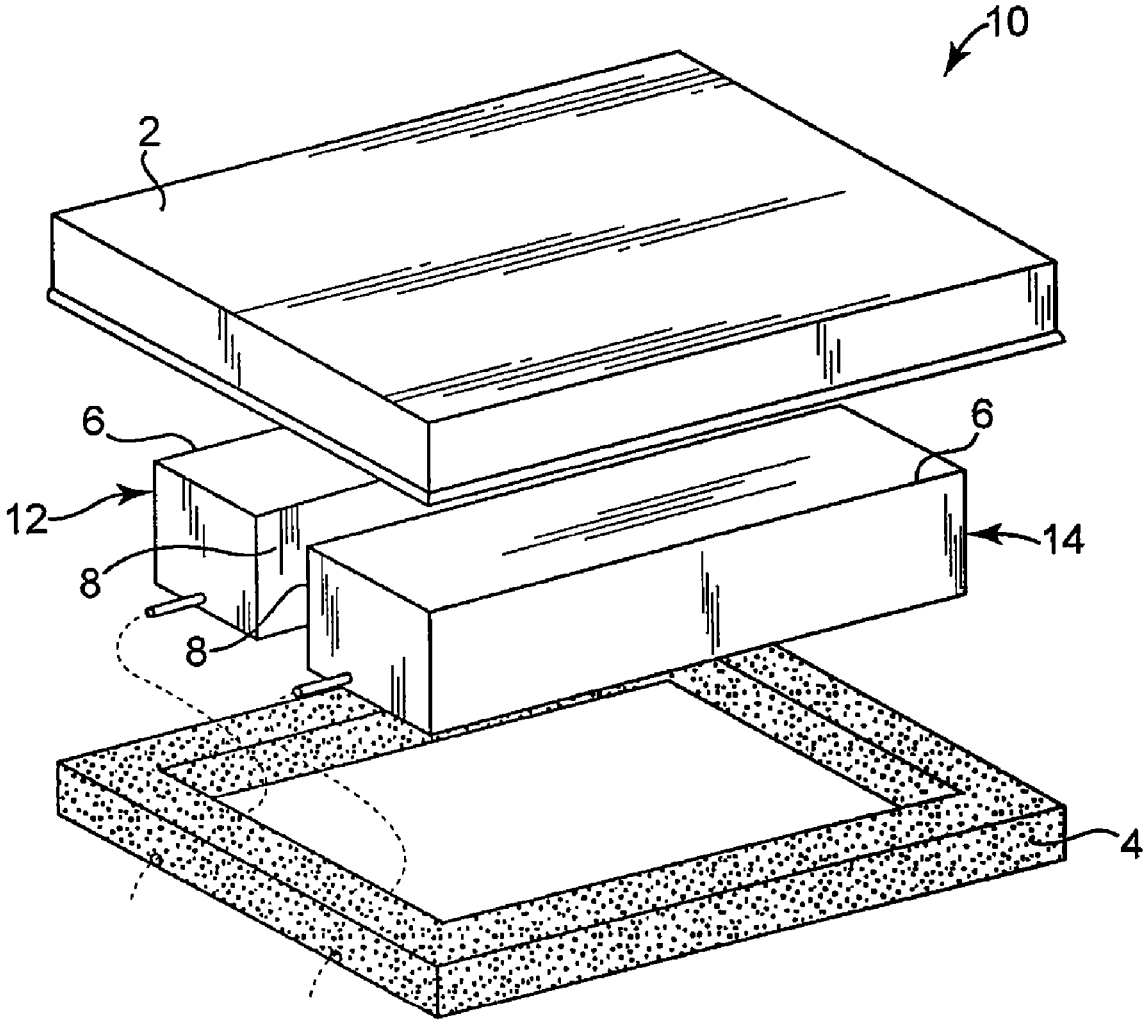
FIG. 1 PRIOR ART
FIG. 1 is a perspective view of a known air mattress having two independent air bladders.
Figure 2:
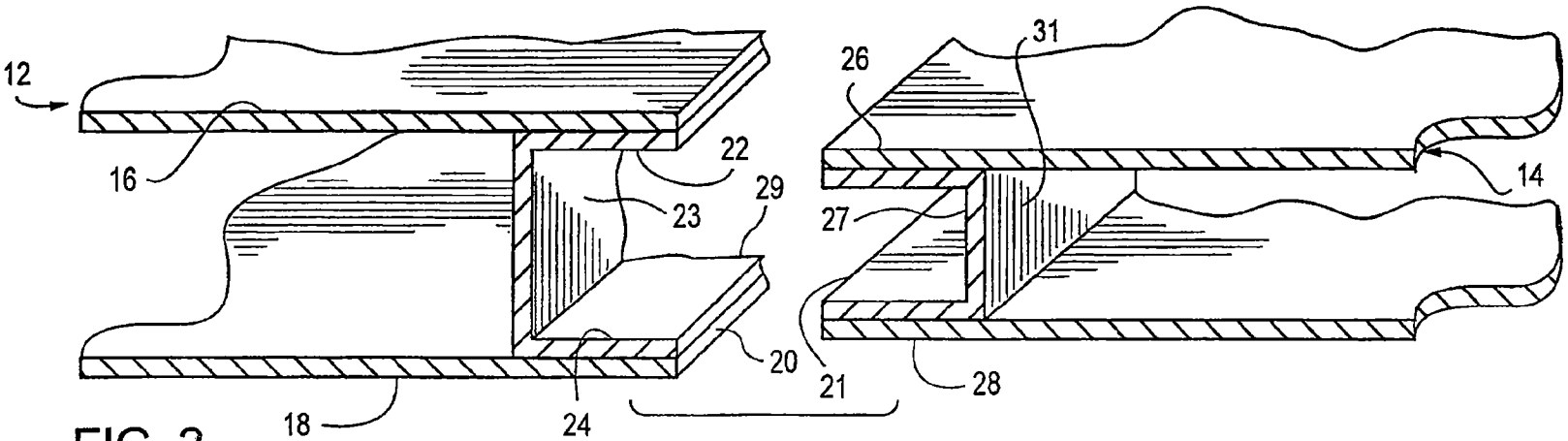
FIG. 2 is a perspective view of sections of two bladders to be joined to form an air mattress in accordance with the present invention.

Referring now to FIG. 2, there is shown a pair of air bladders 12 and 14 that are to be joined to form an air mattress 10 of the present invention. Air mattress 10 is designed to accommodate one person on each bladder 12 and 14. Both of air bladders 12 and 14 have upper surfaces 16, lower surfaces 18 and longitudinal sides. Longitudinal side 20 of first air bladder 12 includes first upper lip 22, first lower lip 24, and first side portion 23 collectively forming a first joining element 29. Similarly, longitudinal side 21 of second bladder 14 includes second upper lip 26, second lower lip 28, and second side portion 27 collectively forming second joining element 31.

Figure 3:
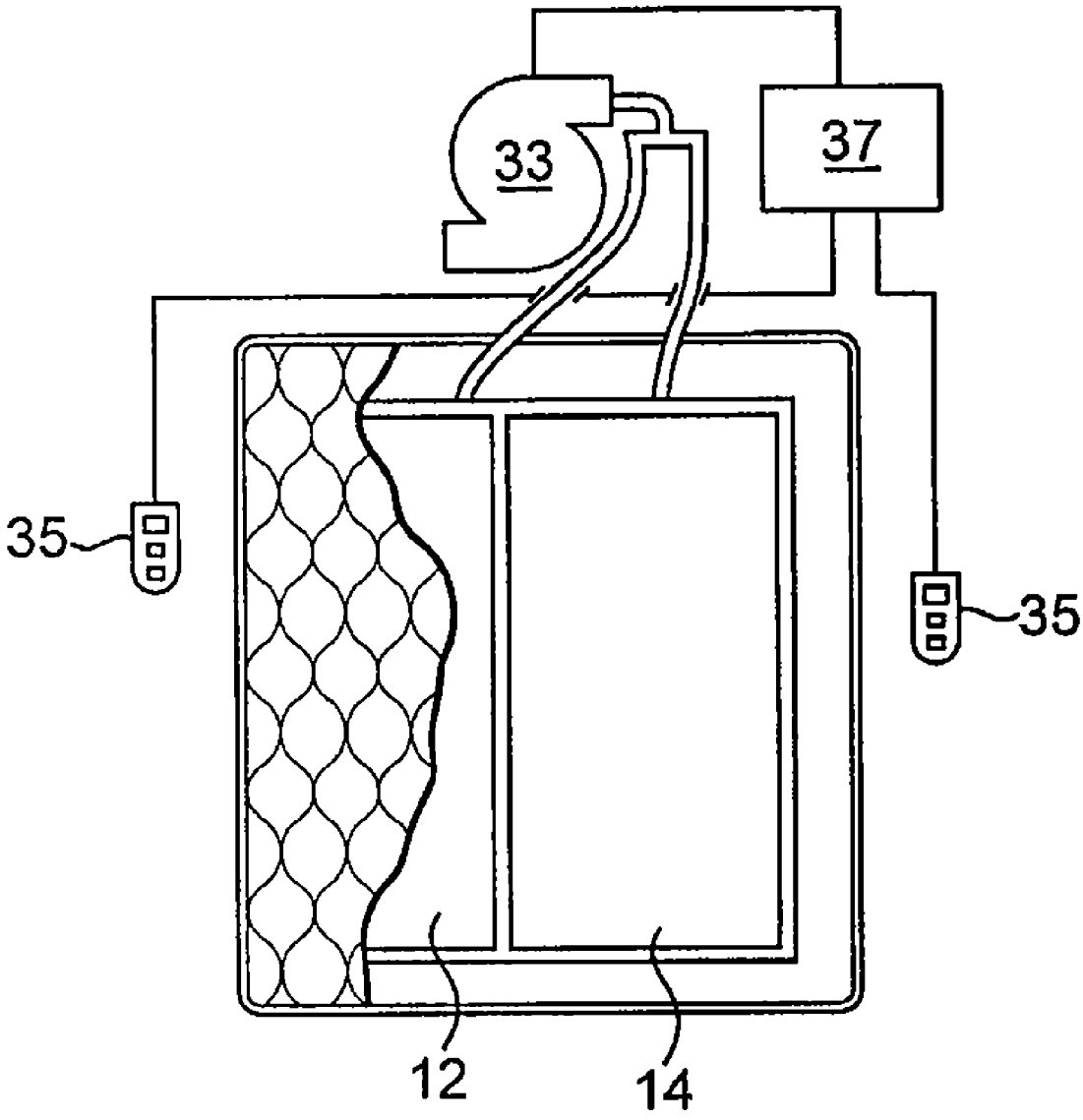
FIG. 3 is a diagrammatic representation of the air mattress of the present invention.

Referring to FIG. 3, bladders 12 and 14 are fluidly attached to pump 33. To the extent that there is more than one bladder, it may be desired to provide a separate pump for each bladder 12 and 14 or to provide one pump operably connected to all of the bladders 12 and 14. Pump 33 is in electrical communication with manual remote controls 35 via control box 37. Control box 37 operates pump 33 to increase or decrease the fluid pressure of bladders 12 and 14.

Figure 4:
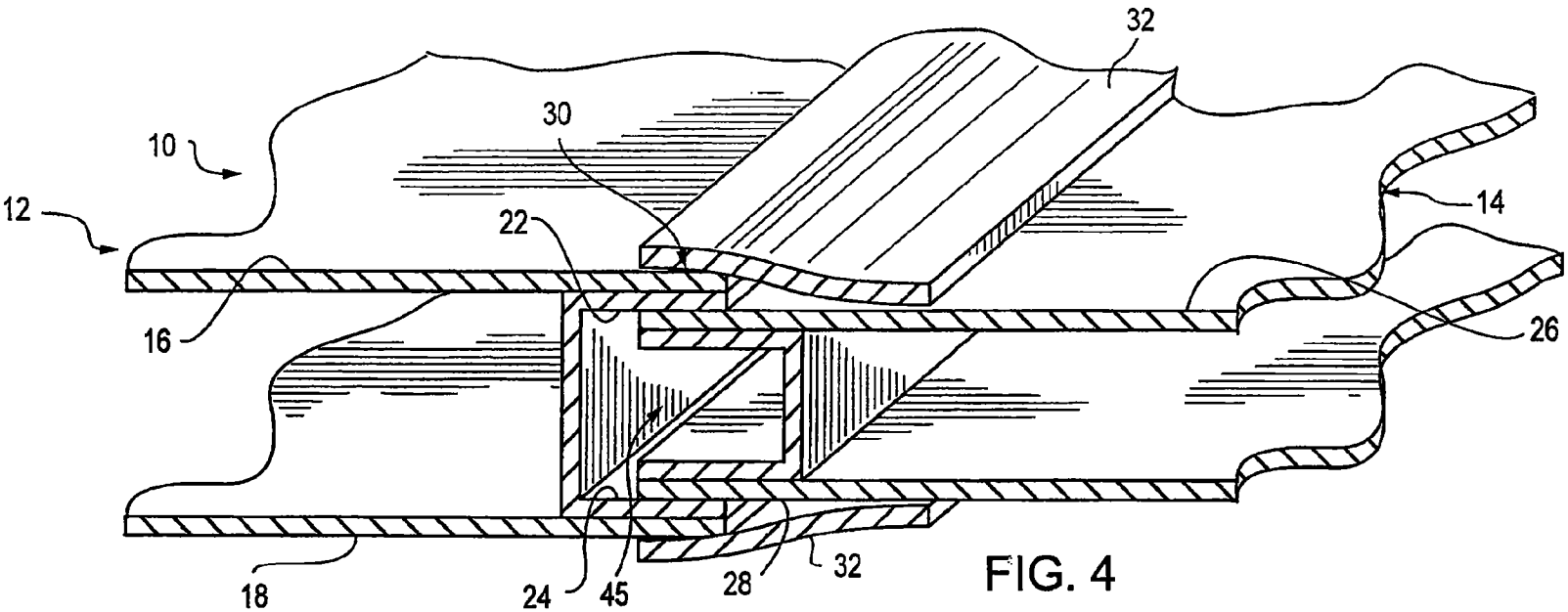
FIG. 4 is a perspective view of a joined portion of one embodiment of the air mattress of the present invention.

Referring now to FIG. 4, air mattress 10 in accordance with the present invention has been formed by joining longitudinal side 20 of first air bladder 12 to longitudinal side 21 of second bladder 14 to form receiving channel 45 bounded by first and second upper lips 22, 26, first and second lower lips 24, 28 and first and second side portions 23, 27

In one embodiment of the present invention, upper surface 16 of first air bladder 12 may be made continuous with upper surface 16 of second air bladder 14 by permanently attaching upper lip 22 of first longitudinal side 20 to upper lip 26 of second longitudinal side 21. In this manner a permanent union 30 is created between first longitudinal side 20 of first air bladder 12 and second longitudinal side 21 of second air bladder 14. One skilled in the art will realize that the term "continuous", as used herein, is referring to the somewhat planar and horizontal upper surface of the resulting air mattress 10. This may be accomplished by joining a portion or all of upper lip 22 of first longitudinal side 20 to upper lip 26 of second longitudinal side 21. Additionally, this union 30 may be intermittent.

The strength and integrity of union 30 may be increased by making lower surface 18 of first air bladder 12 continuous with lower surface 18 of second air bladder 14. This continuity may be achieved by permanently attaching lower lip 24 of first longitudinal side 20 to lower lip 28 of second longitudinal side 21. Permanent union 30 may be achieved through any acceptable joining mechanisms or techniques including, but not limited to, heat welding, zipping, adhering, bonding, or sewing.

More specifically, union 30 of the embodiment shown in FIG. 4 has been formed by overlapping upper lips 22 and 26, overlapping lower lips 24 and 28, and joining the contacting surfaces together. The resulting union 30 is further strengthened, in a preferred embodiment, by adding reinforcement members 32 over the joined lips on upper and lower surfaces 16 and 18, and joining these members to both bladders 12 and 14.

Figure 5:
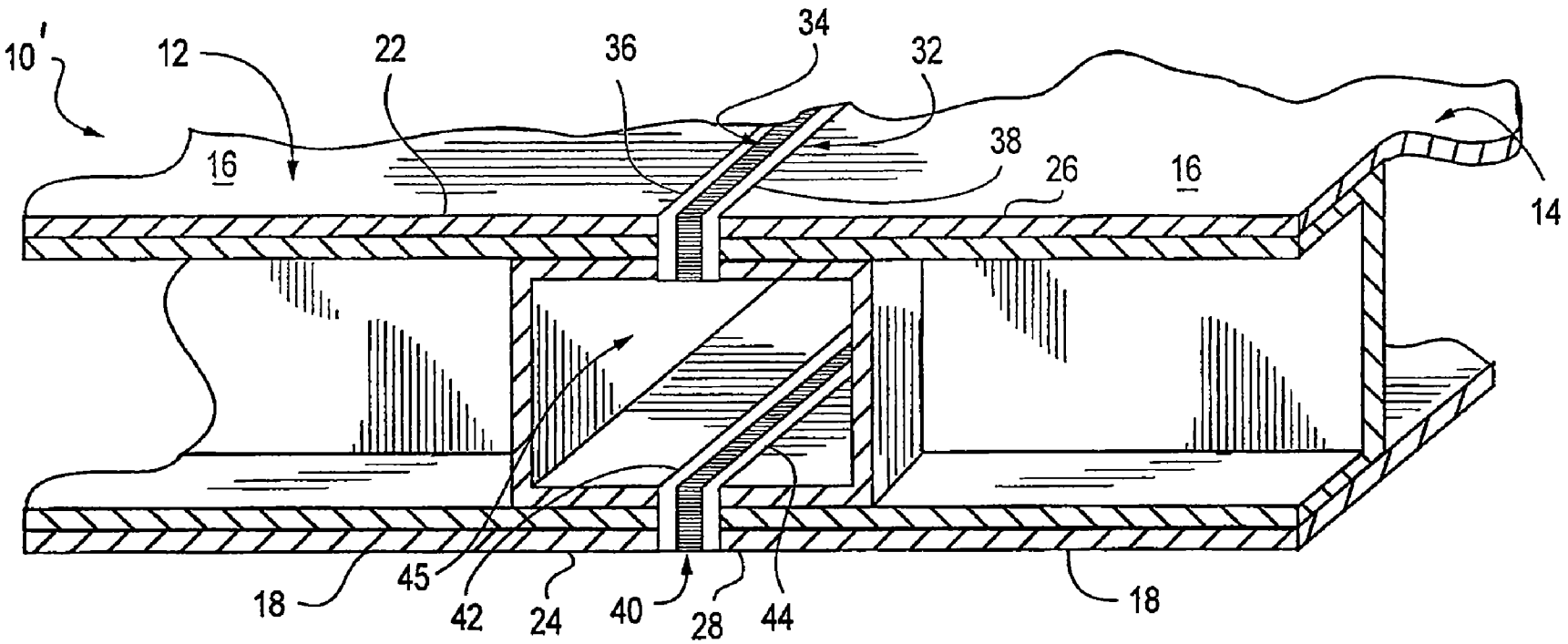
FIG. 5 is a perspective view of a joined portion of an alternative embodiment of the air mattress of the present invention.

Reputable airbed manufacturers warrant the bladders sold against leaks. In the event of a leak in one of bladders 12 or 14, the manufacturer will send a replacement bladder in exchange for the faulty bladder. If the airbed includes an air mattress 10 that includes two bladders 12 and 14 that are permanently joined, the exchange will necessarily include the shipment of a non-defective bladder along with the defective bladder. In order to minimize the additional shipping charges as well as the costs associated with accepting a perfectly functional bladder as defective, an alternative embodiment of an air mattress of the present invention is shown in FIG. 5 that includes a separable union 32 that may be disassembled in the event that it is desired to separate bladders 12 and 14, such as for purposes of exchanging a defective bladder.

Separable union 32 of air mattress 10' is effected by joining mechanism 34. Joining mechanism 34 is shown as a zipper but one skilled in the art will quickly realize that other joining mechanisms may be utilized without departing from the scope of the invention; for example, hook and loop fasteners, adhesives, snaps, laces, buttons, magnets, Velcro and/or the like may be used. Also, union 32 may be continuous, intermittent, or partial. In one embodiment, a first portion 36 of joining mechanism 34 is attached to upper lip 22 of first bladder 12. A second portion 38 of joining mechanism 34 is attached to upper lip 26 of second bladder 14. First portion 36 and second portion 38 are configured to mate with each other in order to form separable union 32. The various portions of joining mechanism 34 may be coupled to bladders 12 and 14 during the bladder manufacturing process, or may alternatively be coupled to the bladders at some later time.

Alternately, separable union 32 further includes a second joining mechanism 40, which may or may not be similar to joining mechanism 34. Joining mechanism 40 includes a first portion 42 attached to lower lip 24 of first bladder 12 and a second portion 44 attached to lower lip 28 of second bladder 14. First and second portions 42 and 44 are configured to mate with each other to join lower lips 24 and 28 together.

Heretofore, unions 30 and 32, either permanent or separable, have been described as being formed along either the top edges of adjacent bladders 12 and 14, or the top and bottom edges of bladders 12 and 14. Some of the objects of the present invention may be accomplished by adjoining bladders 12 and 14 along a mid portion of their adjacent side walls. However, doing so not only lowers the effective "bridge" that is formed between bladders 12 and 14, it necessarily increases the separation force felt by union 30 or 32 when a person is laying on or near union 30 or 32. Therefore, while such a union is contemplated and considered within the scope of this disclosure, the union would have to be of heavier construction to withstand the additional force or contain a support member 46 as described below. Thus, there are advantages to union 30 or 32, either permanent or separable, when the top edges are joined.

Figure 6:
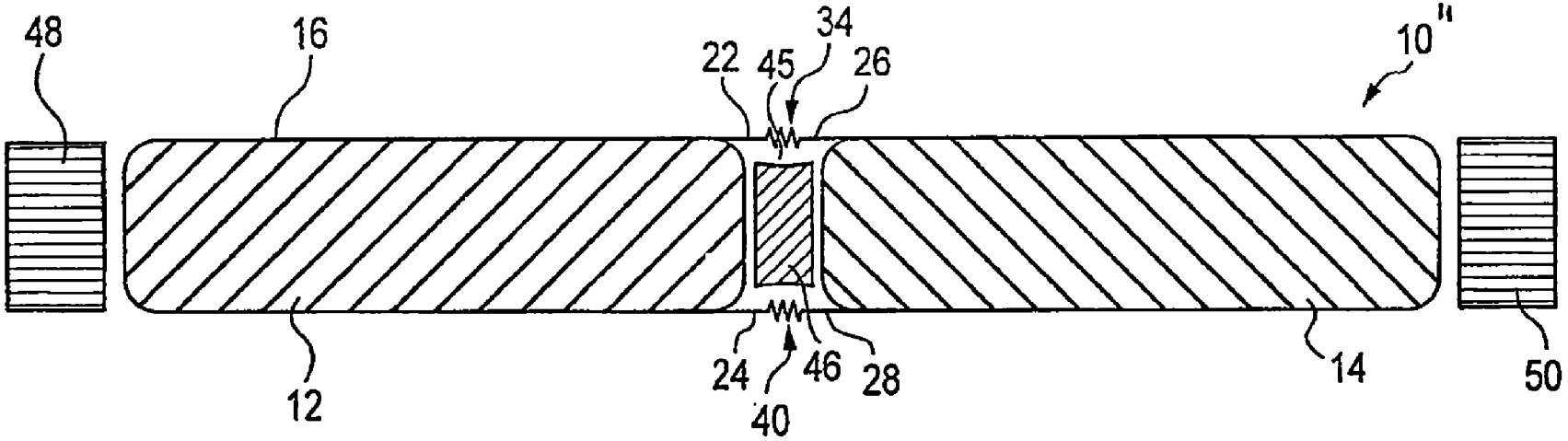
FIG. 6 is a cross-sectional view of a joined portion of another alternative embodiment of the air mattress of the present invention.

Referring now to FIG. 6, there is depicted another alternative embodiment of an air mattress in accordance with the present invention. Air mattress 10" includes permanent union 30 or separable union 32 created by joining mechanism 34 and second joining mechanism 40 as previously discussed. In order to greatly reduce the effects of the "roll to the middle" phenomenon experienced when a person is lying on or near union 30 or 32, a support member 46 is inserted in receiving channel 45 between bladders 12 and 14. In particular, the roll to the middle phenomenon generally refers to the vertical movement that a person feels as he/she is lying on an air bladder and rolls or moves toward the junction between the two bladders near the middle of the air mattress. The vertical movement results in an undesirable sensation that the person is sinking into a low spot in the mattress. In addition, it may be difficult for some individuals to roll from the low point near the middle of the mattress back to his/her side of the air mattress. Thus, providing support member 46 between bladders 12 and 14 creates a flatter, more uniform surface and greatly reduces or eliminates the effects of the roll to the middle phenomenon. Those skilled in the art will appreciate that support member 46 may be constructed of another inflatable member, any type of foam, solid structures or any other materials that provide sufficient support to a person laying on or near union 30 or 32. In one embodiment, support member 46 is constructed of foam. Numerous types of foam may be used such as, for example, polyurethane polyether foam.

Support member 46 is sized to accommodate receiving channel 45 as defined by first and second side portions 23, 27, first and second upper lips 22 and 26, and first and second lower lips 24 and 28. Bladders 12 and 14 can also be positioned between two side rails 48 and 50 attached to a bed frame (not shown) to provide additional support to air mattress 10".

Whether the configuration of the air mattress in accordance with the present invention is that as depicted in FIG. 4, 5 or 6, when deflated, it can fold into a sleeper sofa with ease. Thus, when inflated an air bed mattress can be as thick as a non-air bed mattress to provide sufficient support to a sleeper from the mechanical structure of the bed frame, and when deflated can be thin enough to be independent of the mechanical structure of the sleeper sofa mechanism.

In operation, a sleep surface having a continuous upper surface 16 is created by juxtaposing first bladder 12 and second bladder 14. Once juxtaposed, union 30 or 32 is formed by attaching upper lip 22 of first bladder 12 to upper lip 26 of second bladder 14. Union 30 or 32 may be made stronger by attaching lower lip 24 of first bladder 12 to lower lip 28 of second bladder 14. Alternately, union 30 or 32 may be further supported by inserting support member 46 in receiving channel 45 between bladders 12 and 14.

In order to verify the improvements in the roll to the middle phenomenon exhibited by air mattress 10" having foam support 46 and bladders 12 and 14 that are zippered together, a roll to the middle test was performed on air mattress 10" with a Rollator machine of the type commonly used for testing mattresses in accordance with ASTM standards. However, the Rollator machine was modified such that it was capable of measuring the vertical displacement that would be felt by a person near the junction of bladders 12 and 14. For purposes of comparison, a second dual chamber test air mattress was tested that also included a foam support member 46 disposed between the two bladders. However, the air bladders in the second test mattress did not include upper or lower lips structured to couple the bladders together and create a receiving channel for support member 46.

In order to test air mattress 10" (which will hereinafter be referred to as the "first test mattress"), the mattress was placed on the surface plate of the Rollator machine. The Rollator machine generally included a large cylindrical roller coupled to a traveling arm configured to move the cylindrical roller horizontally across the air mattress. The cylindrical roller had a diameter of about 17 inches, a length of about 36 inches, and weighed about 240 pounds. The traveling arm included two strain gauges configured to measure vertical displacement of the cylindrical roller as it traveled in a horizontal direction across the air mattress. In particular, a strain gauge was positioned on the traveling arm near each end of the cylindrical roller to verify that, as the roller was displaced in a vertical direction, the roller did not tilt or experience any uneven vertical movement. An additional strain gauge coupled to the motor output rod driving the traveling arm in a horizontal direction was configured to provide an accurate measurement of the horizontal position of the cylindrical roller as it traveled across the air mattress. The cylindrical roller was set to a cycle speed of approximately 3.5 cycles per minute, wherein a single cycle was defined by the horizontal movement of the cylindrical roller from the mid-point of one bladder to the mid-point of the other bladder, and then back again. The speed of the cylindrical roller was selected so as to approximate the speed at which a person may roll over while asleep on the air mattress. Data acquisition software coupled to the strain gauges documented vertical displacement of the cylindrical roller as the roller was driven in a horizontal direction back and forth across the air mattress for a number of cycles that ranged from 4 to 7. The data collected by the data acquisition software was then compiled as will be summarized below.

The profile test procedure was performed on the first test mattress at various chamber pressures. In particular, both of the bladders were initially set to a Sleep Number® setting of 100, which corresponds with a bladder pressure of about 0.65 psig. Next, both of the chambers were set to a Sleep Number® setting of 45, which corresponds with a bladder pressure of about 0.32 psig. Finally, one of the bladders was set to a Sleep Number® setting of 70, which corresponds with a bladder pressure of about 0.42 psig, while the other bladder was set to a Sleep Number® setting of 30, which corresponds with a bladder pressure of about 0.26 psig. These three configurations were selected to provide displacement data for a wide range of bladder pressure values.

After completing the entire profile test procedure with the first test mattress at the various bladder pressures described above, the same profile test procedure was performed on the second test mattress.

Next, for each of the three pressure configurations, the average vertical displacement exhibited by the first and second test mattresses was determined by averaging a plurality of data points (dependent upon the number of test cycles) corresponding to the maximum vertical displacement at the junction of the two bladders. These results will be discussed in more detail below in reference to Tables I-III. In addition, the data acquired with the data acquisition software was compiled and displacement profiles were created, as illustrated in FIGS. 7A-9B. In each of the displacement profiles, the x-axis represents the horizontal distance traveled by the cylindrical roller across the mattress, while the y-axis represents the vertical displacement detected by the cylindrical roller at each horizontal mattress position. As shown in the displacement profile figures, the x-axis has a range from 0 inches to 24 inches. The "0" mark represents the mid-point of the first bladder, the "24" mark represents the mid-point of the second bladder, and the "12" mark represents the junction between the first and second bladders where support member 46 was located. Along the y-axis, the data acquisition software was calibrated such that at the starting point of each cycle (i.e., the "0" mark on the x-axis), the vertical displacement was set at 0.00 inches. Thus, the "0.00" mark along the y-axis represents the baseline from which all vertical displacements along the air mattress were measured.

Figure 7A:
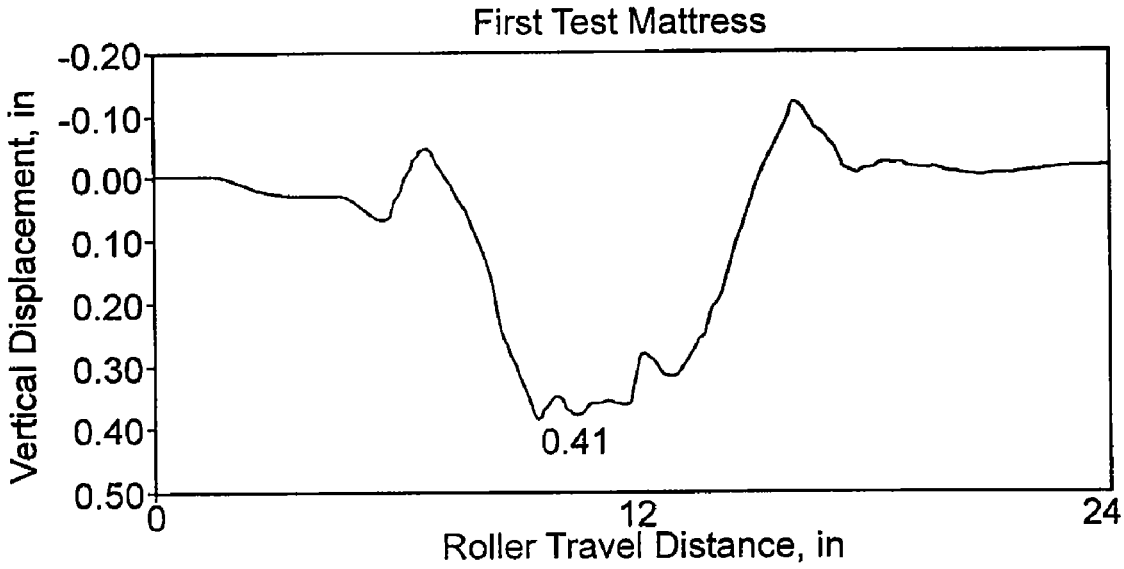
FIG. 7A is a graph illustrating a displacement profile for a first test mattress at a first pressure configuration.
Figure 7B:
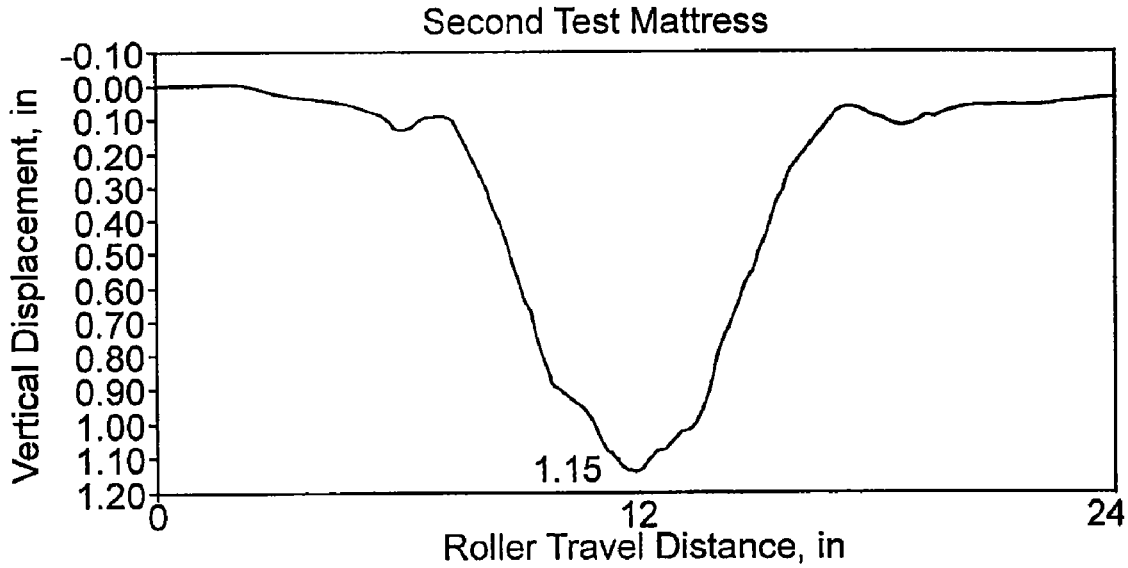
FIG. 7B is a graph illustrating a displacement profile for a second test mattress at the first pressure configuration.

Table I below summarizes the test results for the first and second test mattresses at the first test configuration, wherein both bladders were set to a Sleep Number® setting of 100. In addition, FIG. 7A illustrates the displacement profile for the first test mattress, while FIG. 7B illustrates the displacement profile for the second test mattress. As shown in Table I and FIGS. 7A-7B, the maximum vertical displacement at the junction of the two bladders in the first test mattress was 0.41 inches with a standard deviation of 0.03 inches over 5 test cycles, while the maximum vertical displacement at the junction of the two bladders in the second test mattress was 1.15 inches with a standard deviation of 0.02 inches over 4 test cycles. Thus, as evidenced by the test results in Table I, the first test mattress, which included a foam support disposed within a receiving channel formed by adjacent upper and lower lips of the two bladders zippered together, exhibited a reduction in vertical displacement of 0.74 inches over the second test mattress having a foam support disposed between two bladders that are not zippered together.

TABLE I

| Test Air Mattress | Average Max Displacement (in.) | Standard Deviation (in.) | Number of Test Cycles |
|---|---|---|---|
| First Test Mattress | 0.41 | 0.03 | 5 |
| Second Test Mattress | 1.15 | 0.02 | 4 |

Figure 8A:
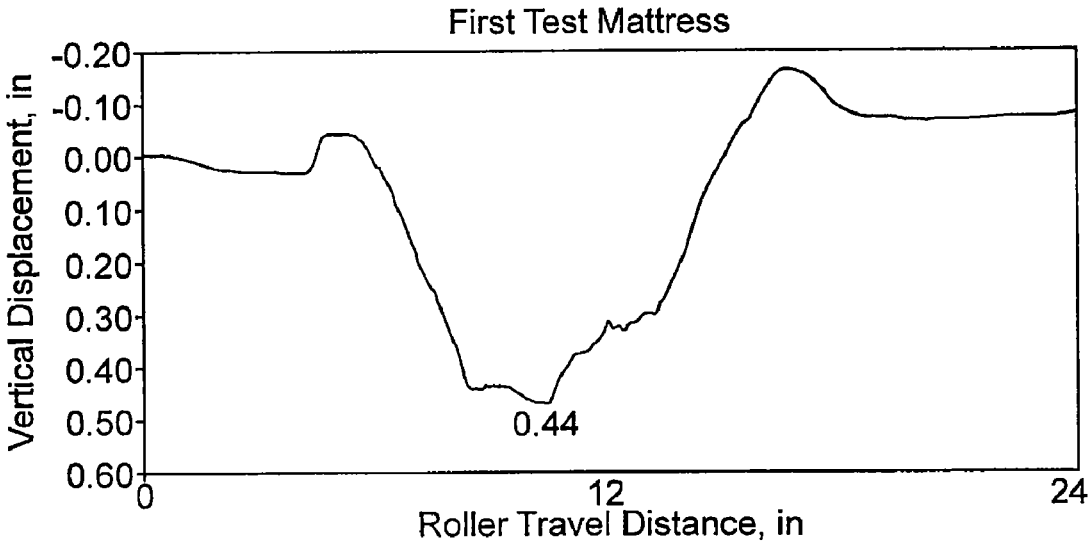
FIG. 8A is a graph illustrating a displacement profile for the first test mattress at a second pressure configuration.
Figure 8B:
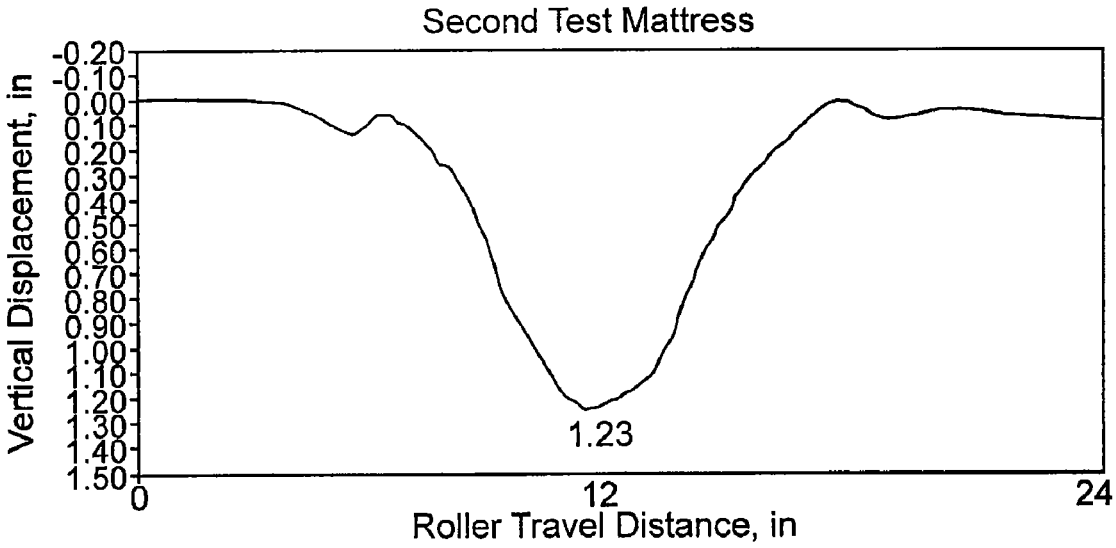
FIG. 8B is a graph illustrating a displacement profile for the second test mattress at the second pressure configuration.

Table II below summarizes the test results for the first and second test mattresses at the second test configuration, wherein both bladders were set to a Sleep Number® setting of 45. In addition, FIG. 8A illustrates the displacement profile for the first test mattress, while FIG. 8B illustrates the displacement profile for the second test mattress. As shown in Table II and FIGS. 8A-8B, the maximum vertical displacement at the junction of the two bladders in the first test mattress was 0.44 inches with a standard deviation of 0.00 inches over 6 test cycles, while the maximum vertical displacement at the junction of the two bladders in the second test mattress was 1.23 inches with a standard deviation of 0.04 inches over 7 test cycles. Thus, as evidenced by the test results in Table II, the first test mattress exhibited a reduction in vertical displacement of 0.79 inches over the second test mattress at the second pressure configuration.

TABLE II

| Test Air Mattress | Average Max Displacement (in.) | Standard Deviation (in.) | Number of Test Cycles |
|---|---|---|---|
| First Test Mattress | 0.44 | 0.00 | 6 |
| Second Test Mattress | 1.23 | 0.04 | 7 |

Figure 9A:
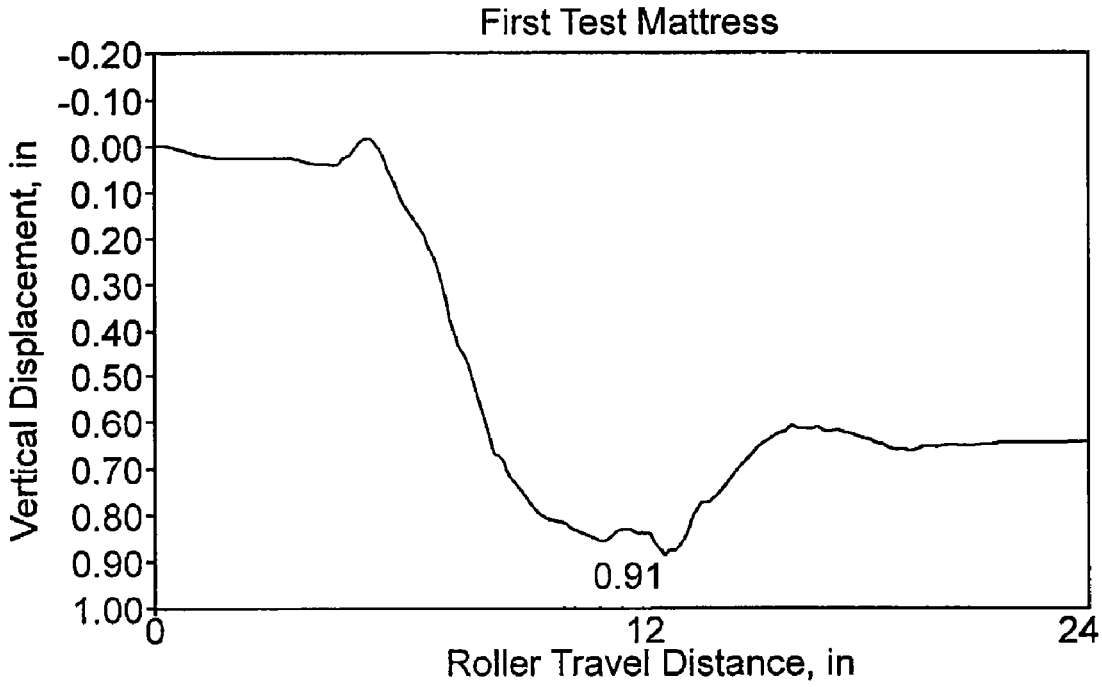
FIG. 9A is a graph illustrating a displacement profile for the first test mattress at a third pressure configuration.
Figure 9B:
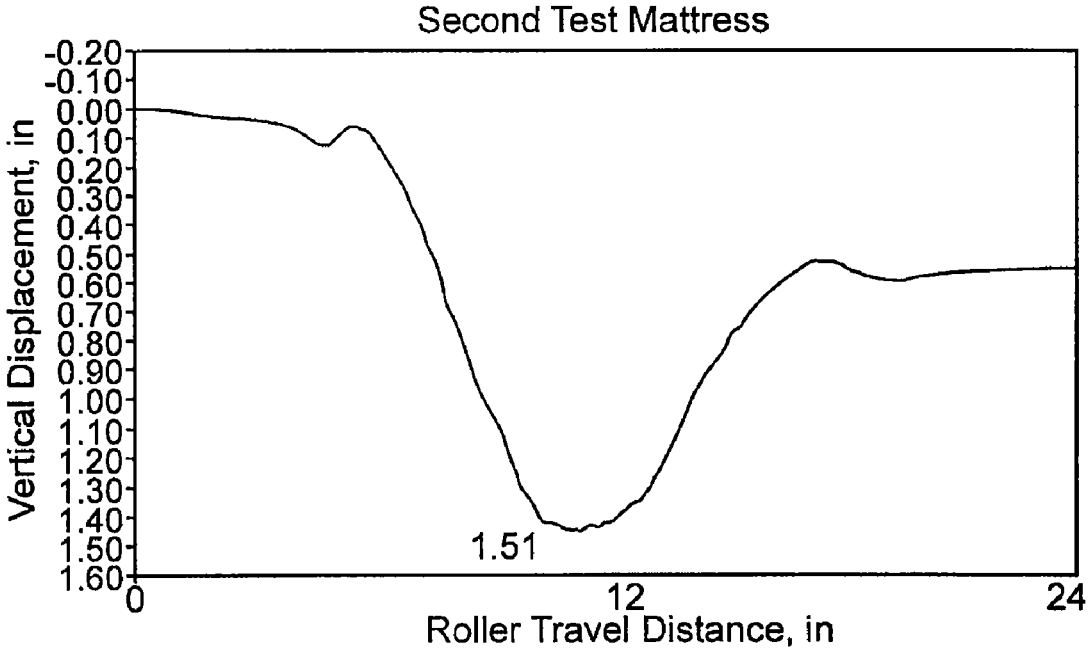
FIG. 9B is a graph illustrating a displacement profile for the second test mattress at the third pressure configuration.

Finally, Table III below summarizes the test results for the first and second test mattresses at the third test configuration, wherein one of the bladders was set to a Sleep Number® setting of 70, while the other bladder was set to a Sleep Number® setting of 30. In addition, FIG. 9A illustrates the displacement profile for the first test mattress, while FIG. 9B illustrates the displacement profile for the second test mattress. As shown in Table III and FIGS. 9A-9B, the maximum vertical displacement at the junction of the two bladders in the first test mattress was 0.91 inches with a standard deviation of 0.04 inches over 5 test cycles, while the maximum vertical displacement at the junction of the two bladders in the second test mattress was 1.51 inches with a standard deviation of 0.05 inches over 7 test cycles. Thus, as evidenced by the test results in Table III, the first test mattress exhibited a reduction in vertical displacement of 0.60 inches over the second test mattress at the third pressure configuration.

TABLE III

| Test Air Mattress | Average Max Displacement (in.) | Standard Deviation (in.) | Number of Test Cycles |
|---|---|---|---|
| First Test Mattress | 0.91 | 0.04 | 5 |
| Second Test Mattress | 1.51 | 0.05 | 7 |

As one skilled in the art will appreciate based upon the test results summarized above, a dual chamber air mattress that includes a support member disposed within a receiving channel formed between two adjacent bladders that are coupled together greatly reduces the effects of the roll to the middle phenomenon. Although the roll to the middle test was performed on an air mattress having a foam support member disposed between two bladders that were zippered together, one skilled in the art will further appreciate that support members formed from other types of materials and coupling means other than zippers may also be used to minimize the roll to the middle phenomenon in accordance with the present invention.

Those skilled in the art will further appreciate that the present invention may be embodied in other specific forms without departing from the spirit or central attributes thereof. In that the foregoing description of the present invention discloses only exemplary embodiments thereof, it is to be understood that other variations are contemplated as being within the scope of the present invention.

Accordingly, the present invention is not limited in the particular embodiments which have been described in detail therein. Rather, reference should be made to the appended claims as indicative of the scope and content of the present invention.

What is claimed is:

1. A sleep surface comprising:

a first bladder having a longitudinal side including a first upper lip and a first lower lip, the first upper and lower lips defining a first portion of a receiving channel therethrough;

a second bladder having a longitudinal side including a second upper lip and a second lower lip, the second upper and lower lips defining a second portion of a receiving channel therethrough, wherein the upper lip of the first bladder is attachable to the upper lip of the second bladder with a first joining mechanism, and wherein the lower lip of the first bladder is attachable to the lower lip of the second bladder with a second joining mechanism; and a support member structured to be disposed within the receiving channel formed between the longitudinal sides of the first and second bladders, said support member and said receiving channel structured and arranged to substantially prevent vertical displacement of a user equal to approximately 0.74 inches to provide a continuous sleep surface;

each bladder being constructed and arranged to maintain an air pressure therein that is independent of an air pressure in the other bladder.

2. The sleep surface of claim 1, wherein the first and second joining mechanisms comprise hook and loop fasteners.

3. The sleep surface of claim 1, wherein the first and second joining mechanisms comprise zippers.

4. The sleep surface of claim 1, wherein the first and second joining mechanisms comprise a plurality of snaps.

5. The sleep surface of claim 1, wherein the support member is an elongate member formed from foam.

6. The sleep surface of claim 1, wherein the first and second upper lips and the first and second lower lips are constructed of a material that is stronger than the material of the sleep surface.

7. A sleep surface comprising:

a first bladder having a longitudinal side including a first upper lip and a first lower lip;

a second bladder having a longitudinal side including a second upper lip and a second lower lip;

an elongate support member consisting essentially of foam;

wherein the first upper lip of the first bladder is attachable to the second upper lip of the second bladder with a first zipper and the first lower lip of the first bladder is attachable to the second lower lip of the second bladder with a second zipper to form a receiving channel for receiving said elongate support member therewithin, wherein the elongate support member and the receiving channel are structured and arranged to provide a continuous sleep surface that substantially reduces roll to the middle of a user equal to approximately 0.74 inches;

each bladder being constructed and arranged to maintain an air pressure therein that is independent of an air pressure in the other bladder.

8. A method of creating an uninterrupted sleeping surface with two bladders comprising:

providing a first elongate bladder having a longitudinal side including a first longitudinal upper lip and a first longitudinal lower lip;

providing a second elongate bladder having a longitudinal side including a second longitudinal upper lip and a second longitudinal lower;

positioning an elongate support member between the longitudinal sides of the first and second elongate bladders; and joining the first longitudinal upper lip with the second longitudinal upper lip and the first longitudinal lower lip with the second longitudinal lower lip;

providing a continuous sleep surface formed by said first longitudinal upper and lower lips, said second longitudinal upper and lower lips and said elongate support member to substantially prevents vertical displacement of a user equal to approximately 0.74 inches.

9. The method of claim 8, wherein joining the first longitudinal upper lip with the second longitudinal upper lip comprises heat welding the first longitudinal upper lip to the second longitudinal upper lip.

10. The method of claim 8, wherein joining the first longitudinal upper lip with the second longitudinal upper lip comprises zipping the first longitudinal upper lip to the second longitudinal upper lip.

11. The method of claim 8, wherein joining the first longitudinal upper lip with the second longitudinal upper lip comprises fastening the first longitudinal upper lip to the second longitudinal upper lip with a hook and loop fastener system.

12. A sleep surface for two people comprising:

a first bladder having a longitudinal side including a first upper lip and a first lower lip, the first upper lip having a first portion of a first joining mechanism and the first lower lip having a first portion of a second joining mechanism;

a second bladder having a longitudinal side including a second upper lip and a second lower lip, the second upper lip having a second portion of the first joining mechanism and the second lower lip having a second portion of the second joining mechanism; and a support member longitudinally positioned between the first and second bladders within a receiving channel defined by the longitudinal sides of the first and second bladders, the first and second upper lips, and the first and second lower lips, said support member constructed and arranged to prevent vertical displacement of two people on said sleep surface equal to approximately 0.74 inches to provide a continuous sleep surface;

wherein each bladder is constructed and arranged to maintain an air pressure therein that is independent of an air pressure in the other bladder.

13. The sleep surface of claim 12, wherein the first and second joining mechanisms are hook and loop fasteners.

14. The sleep surface of claim 12, wherein the first and second joining mechanisms are zippers.

15. The sleep surface of claim 12, wherein the first and second joining mechanisms are a plurality of snaps.

16. The sleep surface of claim 12, wherein the support member comprises foam.

17. The sleep surface of claim 12, wherein the air pressure of the bladders is maintained with one air pump in fluid communication with all of the bladders.

18. The sleep surface of claim 12, wherein the air pressure of the first bladder is maintained with a first air pump, and wherein the air pressure of the second bladder is maintained with a second air pump.

19. A method of creating an uninterrupted sleeping surface with two bladders comprising:

providing a first elongate bladder having a first longitudinal upper lip and a first longitudinal lower lip, the first longitudinal upper lip having a first portion of a first joining mechanism thereon and the first longitudinal lower lip having a first portion of a second joining mechanism thereon;

providing a second elongate bladder having a second longitudinal upper lip and a second longitudinal lower lip, the second longitudinal upper lip having a second portion of the first joining mechanism thereon and the second longitudinal lower lip having a second portion of the second joining mechanism thereon;

providing a support member;

positioning the first bladder and the second bladder next to one another such that a longitudinal side of the first bladder is parallel to a longitudinal side of the second bladder;

positioning the support member longitudinally between the first bladder and the second bladder, wherein the support member is positioned within a receiving channel defined by the longitudinal sides of the bladders, the first and second longitudinal upper lips, and the first and second longitudinal lower lips, wherein said support member and said receiving channel formed by said upper lips and said lower lips are structured and arranged to provide a continuous sleep surface that substantially reduces roll to the middle of a user and vertical displacement on said sleep surface equal to approximately 0.74 inches to provide a continuous sleep surface; and joining the first portions of the first and second joining mechanisms to the second portions of the first and second joining mechanisms.

20. The method of claim 19, wherein the first and second joining mechanisms are hook and loop fasteners.

21. The method of claim 19, wherein the first and second joining mechanisms are zippers.

22. The method of claim 19, wherein the first and second joining mechanisms are a plurality of snaps.

23. The method of claim 19, wherein the support member comprises foam.

24. The method of claim 19, further comprising maintaining the air pressure of the bladders independently of one another with one air pump in fluid communication with all of the bladders.

25. The method of claim 19, further comprising maintaining the air pressure of the bladders independently of one another with individual air pumps separately in fluid communication with the first and second bladders.

26. A sleep surface comprising:

a first bladder having a longitudinal side including a first upper lip, the first upper lip having a first portion of a first zipper mechanism;

a second bladder having a longitudinal side including a second upper lip, the second upper lip having a second portion of the first zipper mechanism;

a elongate support member consisting essentially of foam;

wherein the first zipper mechanism is structured to couple the first upper lip of the first bladder to the second upper lip of the second bladder to form a receiving channel for receiving the elongate support member therewithin, wherein said elongate support member and said receiving channel are structured and arranged to reduce vertical displacement of a user equal to approximately 0.74 inches to provide a continuous sleep surface;

each bladder being constructed and arranged to maintain an air pressure therein that is independent of an air pressure in the other bladder.

27. The sleep surface of claim 26, wherein the first bladder further includes a first lower lip having a first portion of a second zipper mechanism, and wherein the second bladder further includes a second lower lip having a second portion of the second zipper mechanism, the second zipper mechanism structured to couple the first lower lip to the second lower lip.

28. The sleep surface of claim 26, further comprising an air pump in fluid communication with the first and second bladders and structured for maintaining the air pressure of the bladders independently of one another.

29. The sleep surface of claim 26, further comprising:

a first air pump in fluid communication with the first bladder; and a second air pump in fluid communication with the second bladder;

wherein the first and second air pumps are structured for maintaining the air pressures of the first and second bladders, respectively, independently of one another.

* * * * *

UNITED STATES PATENT AND TRADEMARK OFFICE

CERTIFICATE OF CORRECTION

PATENT NO. : 7,865,988 B2
APPLICATION NO. : 11/753387
DATED : January 11, 2011
INVENTOR(S) : Koughan et al.

It is certified that error appears in the above-identified patent and that said Letters Patent is hereby corrected as shown below:

In Section (75), line 2, please replace “Tracey” with --Tracy--

Signed and Sealed this
Fifteenth Day of March, 2011

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,865,988 B2
APPLICATION NO. : 11/753387
DATED : January 11, 2011
INVENTOR(S) : Koughan et al.

It is certified that error appears in the above-identified patent and that said Letters Patent is hereby corrected as shown below:

Title page, Item (75) line 2, Inventors, please replace "Tracey" with --Tracy--

This certificate supersedes the Certificate of Correction issued March 15, 2011.

Signed and Sealed this
Twenty-sixth Day of April, 2011

David J. Kappos

David J. Kappos
*Director of the United States Patent and Trademark Office*